United States Patent [19]

Florian

[11] B 4,057,651

[45] Nov. 8, 1977

[54] MEAT TRAY

[75] Inventor: John Florian, Bakersfield, Calif.

[73] Assignee: Mobil Oil Corporation, New York, N.Y.

[21] Appl. No.: 537,990

[22] Filed: Jan. 2, 1975

[44] Published under the second Trial Voluntary Protest Program on January 13, 1976 as document No. B 537,990.

[51] Int. Cl.[2]...B65D 1/36; B65D 81/26; B65D 85/00

[52] U.S. Cl. ..426/129; 229/2.5 R; 229/29 M; 99/425

[58] Field of Search ..... 229/2.5; 426/124, 129, 426/106, 112; 220/66; 99/425, 445, 446; 217/26.5

[56] References Cited

U.S. PATENT DOCUMENTS

| | | | |
|---|---|---|---|
| 1,866,035 | 7/1932 | Hart et al. | 229/2.5 |
| 3,337,110 | 8/1967 | Commisso et al. | 229/29 M |
| 3,346,400 | 10/1967 | Roesmer | 229/2.5 |
| 3,420,431 | 1/1969 | Donovan | 229/2.5 |
| 3,485,434 | 12/1969 | Donovan et al. | 229/2.5 |
| 3,778,516 | 12/1973 | Cornelius | 229/2.5 X |
| 3,834,606 | 9/1974 | Andersson | 229/2.5 |
| 3,885,727 | 5/1975 | Gilley | 229/2.5 |

OTHER PUBLICATIONS

Foil container catalog, EKCO Products, Inc. May 1973.

*Primary Examiner*—Davis T. Moorhead

*Attorney, Agent or Firm*—Charles A. Huggett; James D. Tierney

[57] ABSTRACT

A meat tray of thermoformed plastic foam is provided with high side walls of sufficient stability to retain cut pieces by vertical flutes in the side walls and at the corners.

3 Claims, 5 Drawing Figures

FIG. 1
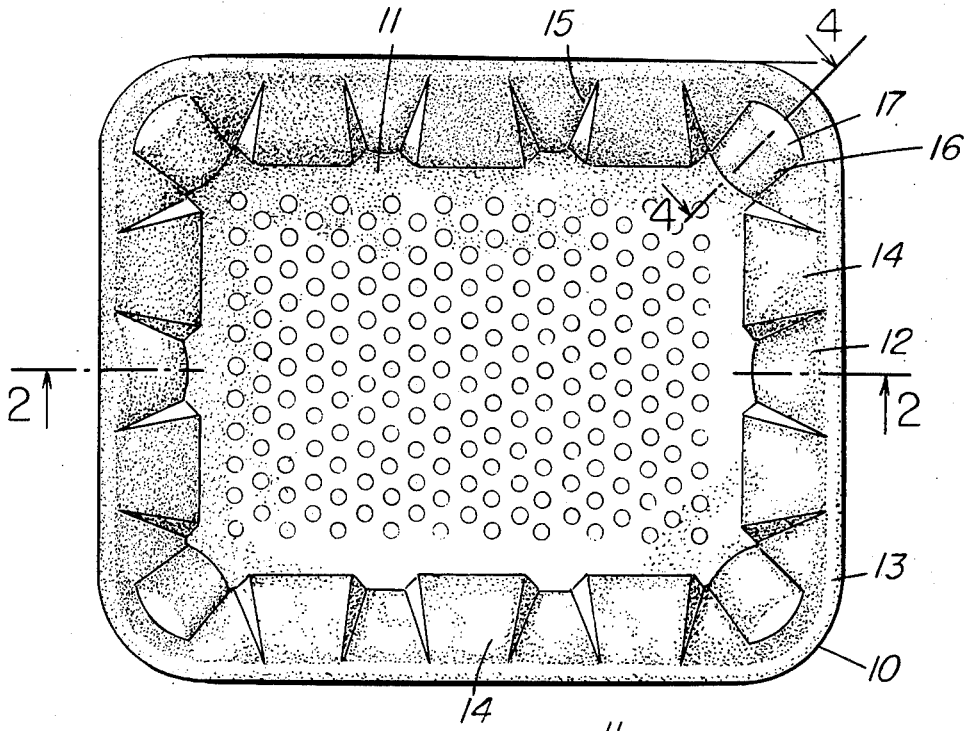
FIG. 3
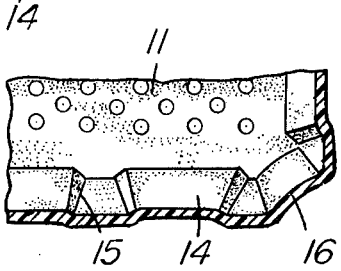
FIG. 2
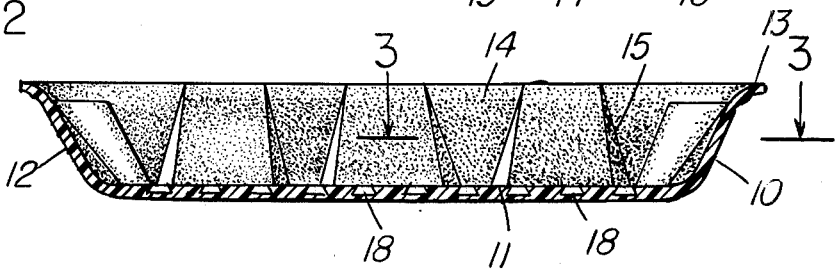
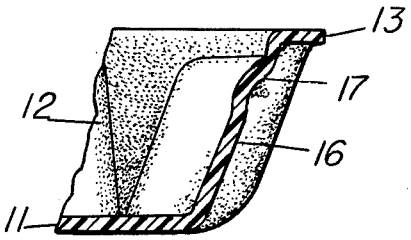
FIG. 4

MEAT TRAY

BACKGROUND OF THE INVENTION

It has been common practice for many years to package meat products in flat trays formed by molding techniques. These may be formed of paper pulp by flowing a water suspension of fibers onto a screen and drawing suction on the side of the screen remote from supply of the pulp, causing the fibers to mat in a more or less uniform thickness following the contours of the screen.

More recently, trays of similar form have been prepared by thermoforming a sheet of foamed thermoplastic resin, typically polystyrene.

In either event, the trays have been constituted by a flat, generally rectangular bottom and outwardly flared side walls of modest height. A usual meat tray will have a depth of about one-half inch, measured vertically from the upper edge of the side walls to the bottom inner surface. Such trays are generally satisfactory for packaging of single pieces of meat placed on trays and overwrapped, as with transparent shrink film.

These shallow trays, for lack of anything more suitable are also employed in preparing a package of many meat pieces; for example dismembered chicken parts, cubes of stew beef and the like. In such multiple piece packages, the sides of the packaged product are provided primarily by the overwrap. These packages are clumsy to prepare, awkward to store and tricky to unwrap.

SUMMARY OF THE INVENTION

The disadvantage of low side walls on formed meat trays can be overcome without the expected result of flimsy, unstable side walls making the package even more difficult for use in packaging of meat or poultry parts. The purposes of the invention are achieved by forming the walls with a plurality of depressed flutes across the walls, whereby are provided the strengths inherent in webs at an angle to each other. In addition to the strengthening angles formed across the width of the side walls, the corners at which those walls meet are inverted (or fluted) through a portion of their height to afford further strengthening angles.

The whole presents a pleasing appearance, combining attractiveness of package with increased stability of package as a whole and increased security for the packaged product, particularly when the latter is inherently formless, e.g., dismembered chicken parts.

DESCRIPTION OF THE DRAWINGS

A thermoformed tray which overcomes those disadvantages is shown in the annexed drawings wherein:

FIG. 1 is a plan view of a tray according to this invention having suitable depth for packaging chicken parts and the like, the side walls of which are strengthened and stabilized by a system of wall elements meeting at angles;

FIG. 2 is a vertical section on line 2—2 of FIG.l;

FIG. 3 is a fragmentary section on line 3—3 of FIG. 2;

FIG. 4 is a fragmentary section on line 4—4 of FIG. 1; and

DESCRIPTION OF SPECIFIC EMBODIMENT

Figure 5:
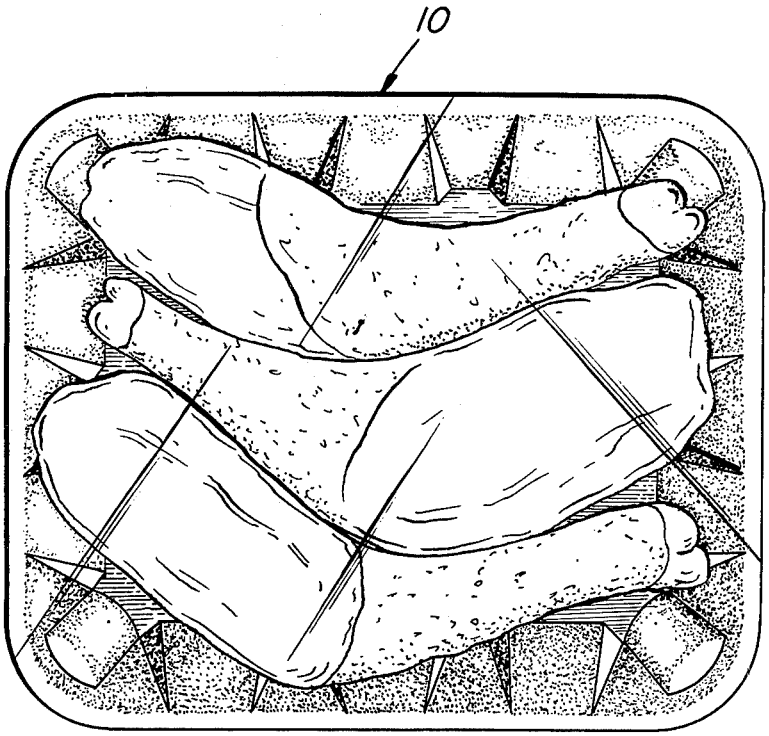

A plan view of a meat tray 10 according to the invention is shown in FIG. 1 as a unitary article having a bottom 11 and side walls 12 integral with bottom 11 and with each other. The side walls 12 flare outwardly from the bottom in the manner shown and may be of any desired number and of any desired ratio of length to each other. It is preferred that the tray be generally rectangular in plan for convenience in storage, transportation and handling at the point of use. The outwardly flared walls are conventional to provide ease of removal from molds, compact nesting for shipping and storage, and ready removal of a tray from a nested stack. The present invention preserves these advantages in forming, storing, shipping and using the trays while affording a large measure of stability and security by a system of angles in the side walls and corners which do not impair those necessary qualities of easy removal from molds, snug nesting and ready denesting.

The upper edges of the walls 12 are formed with outwardly disposed flange 13 which forms an angle with the walls 12 effectively strengthening those walls against stresses generally in the plane of flange 13.

Across the width of walls 12, a series of depressed flutes 14 are formed to have shoulders which are at an angle to the plane of each side. For smooth molding operation and pleasing appearance, the junctures of a shoulder 15 with the plane of side 12 and with the bottom of depressed flute 14 are gently rounded to fair in with the surfaces so met. It is found that such esthetic and practical configurations contribute significantly to the utility and customer acceptance of packages of cut meats.

The package is further strengthened by flutes 16 in the corners which constitute a reversal of the corner curvature extending from the bottom 11 a portion of the distance toward the flange 13 and terminating in a shoulder 17 spaced below the flange 13. The flute 16 and its upper shoulder 17 provide webs set at angles to each other which afford real resistance to distortion of the package under stress.

Preferably the bottom 11 of the container 10 is provided with small holes 18 to receive and retain juices from the meat contained in the package. These are advantageously formed by the cold punching technique described in my prior copending application Ser. No. 371,819, filed June 20, 1973, the disclosure of which is hereby incorporated by this reference. When so formed, the holes are larger at the bottom portion than at the top opening as indicated in FIG. 2.

I claim:

1. A package consisting of a plurality of pieces of cut meat in a tray comprising a flat rectangular bottom wall having rounded corners and having a plurality of holes therein to receive and retain juices, side walls integral with said bottom wall disposed upwardly and flared outwardly of said bottom wall, each of said side walls being integral with adjacent side walls at the curved corners of said tray, an integral flange extending outwardly of said side walls at the upper edges thereof, said side walls being formed with flutes transversely of said walls from the bottom wall to said flange, the curved corner surfaces at joinder of said side walls being formed as an upper portion adjacent said flange in a smooth curve to which said side walls are tangent and a lower portion in a smooth surve of curvature reverse to that of said upper portion to thereby provide a fluted corner terminating at a shoulder between said portion and an overwrap of transparent film about said tray and pieces of meat contained therein.

2. A tray particularly suited to packaging of cut meats comprising a flat rectangular bottom wall having rounded corners and having a plurality of holes therein to receive and retain juices, side walls integral with said bottom wall disposed upwardly and flared outwardly of said bottom wall, each of said side walls being integral with adjacent side walls at the curved corners of said tray, an integral flange extending outwardly of said side walls at the upper edges thereof, said side walls being formed with flutes transversely of said walls from the bottom wall to said flange, the curved corner surfaces at joinder of said side walls being formed as an upper portion adjacent said flange in a smooth curve to which said side walls are tangent and a lower portion in a smooth curve of curvature reverse to that of said upper portion to thereby provide a fluted corner terminating at a shoulder between said portions.

3. An article according to claim 2 in which said holes are of smaller diameter at the top thereof than at the bottom.

* * * * *

UNITED STATES PATENT AND TRADEMARK OFFICE

CERTIFICATE OF CORRECTION

PATENT NO. : 4,057,651
DATED : November 8, 1977
INVENTOR(S) : John Florian

It is certified that error appears in the above-identified patent and that said Letters Patent are hereby corrected as shown below:

Column 1, line 64 Before "DESCRIPTION OF SPECIFIC EMBODIMENT" insert --FIG. 5 is a plan view of a meat tray according to the invention, filled with cut meat and wrapped in transparent film.--.

Column 2, line 63 "surve" should be --curve--.

Column 2, line 65 "portion" should be --portions--.

Signed and Sealed this

Second Day of May 1978

[SEAL]

Attest:

RUTH C. MASON
Attesting Officer

LUTRELLE F. PARKER
Acting Commissioner of Patents and Trademarks